United States Patent [19]

Brener

[11] 4,042,214

[45] Aug. 16, 1977

[54] OVERHEAD CRANE INCLUDING AN IMPROVED HOIST DRUM AND REDUNDANT HOIST DRUM SUPPORT MEANS

[75] Inventor: Richard F. Brener, Wauwatosa, Wis.

[73] Assignee: Harnischfeger Corporation, West Milwaukee, Wis.

[21] Appl. No.: 680,133

[22] Filed: Apr. 26, 1976

[51] Int. Cl.[2] ..... B66D 1/00

[52] U.S. Cl. ..... 254/186 R; 308/15

[58] Field of Search ..... 254/186 R, 150 R, 168, 254/186 HC, 173 R; 308/15, 27; 212/71, 76; 248/1, 2

[56] References Cited

U.S. PATENT DOCUMENTS

| | | | |
|---|---|---|---|
| 2,053,055 | 9/1936 | Wadd | 254/168 |
| 2,247,795 | 7/1941 | Whitcomb et al. | 254/168 |
| 2,345,662 | 4/1944 | Fox et al. | 254/186 |
| 2,710,738 | 6/1955 | Wittberger | 254/186 |
| 2,872,130 | 2/1959 | Nardone | 254/186 R |

*Primary Examiner*—Robert J. Spar
*Assistant Examiner*—Kenneth Noland
*Attorney, Agent, or Firm*—James E. Nilles

[57] ABSTRACT

An overhead crane which includes an improved hoist drum and redundant means for supporting the hoist drum such that the hoist drum will be rotatably operable despite failure of the hoist drum or hoist drum support means. The hoist drum includes an outer cylindrical drum, an inner hollow cylinder positioned within the outer drum, and a pair of bearing shafts rigidly secured to and projecting from opposite ends of the inner hollow cylinder. A first pair of bearing assemblies are provided to rotatably support the bearing shafts and to function as the primary means for rotatably supporting the opposite ends of the hoist drum. A second pair of bearing assemblies, independently supported by the trolley, support the opposite ends of the hoist drum and function to provide independent means for directly rotatably supporting the hoist drum in the event of a failure of one of the bearing shafts or of the first pair of bearing assemblies. When the hoist drum is supported by the first pair of bearing assemblies, the second pair of bearing assemblies are supported by the hoist drum. However, when there is a failure of the first pair of bearing assemblies or bearing shafts and a consequent drop of the hoist drum, the second bearing assembly is received against a support structure in supporting engagement and functions to rotatably support the hoist drum.

8 Claims, 5 Drawing Figures

20
25
44
42
40
41a
41
41b
21
21a
45
45b
22a
36
36c
36a
30
36d
32
31a
31
26
28
27
33
24
34
36b
23
22
37
60
39
43a
50
43
48
49
6

OVERHEAD CRANE INCLUDING AN IMPROVED HOIST DRUM AND REDUNDANT HOIST DRUM SUPPORT MEANS

BACKGROUND OF THE INVENTION

The present invention relates to overhead cranes which are used to support critical loads such as extremely expensive generator-turbine components used in a powerhouse, or hazardous materials such as molten metal.

Overhead cranes of the type referred to generally comprise a trolley supported on overhead tracks or rails. The trolley in turn supports a large power driven cylindrical drum. A wire rope is wound around the drum and used to support a load bearing hook and to lift a load suspended by the hook. Since even the utmost care in manufacturing cannot completely preclude the possibility of failure of any single component of the crane, it is desirable when handling critical loads to provide an auxiliary or redundant means for supporting the load in the event of a failure of one of the crane components. The prior art means of compensating for such failure has generally comprised the use of two hoist drums for supporting the load. Other more recently developed means include the use of hoist drum catchers positioned beneath the hoist drum and functioning to support the hoist drum in the event of the failure of its other support means. See, for example, U.S. Patent application Ser. No. 653,741, filed Jan. 30, 1976 by Raugulis et al. and assigned to an assignee in common with that of the present invention. Providing a catcher position below the hoist drum is effective to prevent the load from being dropped, however, such a redundant drum support means is limited in that it requires that the load either be held in suspension or set down upon failure of a drum support component and does not permit raising of a load for proper disposal of the load.

SUMMARY OF THE INVENTION

The present invention includes an overhead crane having an improved hoist drum and redundant means for supporting the hoist drum which facilitate continued rotational operation of the hoist drum despite failure of a support means. Generally, the overhead crane of the invention includes a hoist drum having an outer cylinder or drum and an inner hollow cylinder concentrically received axially within the outer drum and supporting the drum. The hoist drum also includes a pair of bearing shafts rigidly supported concentrically within each of the opposite ends of the inner hollow cylinder and projecting from these ends. Each of the bearing shafts are rotatably supported by a bearing assembly in order to provide a primary means for rotatably supporting the drum. A secondary or redundant means for supporting the hoist drum is provided by a second pair of bearing assemblies which are journalled around the opposite ends of the inner hollow cylinder and independently supported and function to provide rotatable support for the hoist drum in the event of failure of one of the bearing shafts or one of the bearing assemblies supporting the bearing shafts.

In operation, the hoist drum is normally supported by the bearing shafts and by the first pair of bearing assemblies, and the second pair of bearing assemblies are supported by the ends of the inner hollow cylinder and spaced above a supporting surface. However, in the event of a failure of one of the bearing shafts or one of the bearing assemblies, the second bearing assembly will drop into supporting engagement against the supporting surface and will function to rotatably support the inner hollow cylinder and thus function to support the hoist drum.

By providing the hoist drum of the present invention with two concentric supporting shafts, i.e., the inner hollow cylinder and the bearing shafts, each being independently supported by an independent bearing assembly, the hoist drum can be rotatably supported despite failure of one of the supporting shafts or of a component of the supporting structure. Merely providing a single support shaft supported at each end by first and second bearing assemblies would be less effective because failure of the single support shaft could cause complete failure of the hoist drum. In the present invention, on the other hand, despite a failure of one of the bearing shafts, the inner hollow cylinder, supported by its supporting bearing assemblies, will provide independent support for the hoist drum.

An advantage of the present invention is that the hoist drum and the redundant means of supporting the hoist drum as described above provide redundant support for the load without using the complicated plural hoist drum and consequent plural drive systems generally used by the prior art systems. The present invention thus substantially simplifies the structure required to support a critical load and makes handling of the load easier and safer.

A further advantage of the invention is that failure of a component element of the primary support means does not prevent further rotation of the hoist drum and thereby require shut down of the machine. The redundant bearing assembly assumes support for the load and it is possible to continue operation of the overhead crane to properly dispose of the load on the crane.

The advantages of the invention set forth above and other advantages will be more fully described in the following description of a preferred embodiment of the invention. Though the drawing and the following description of a preferred embodiment define only a single embodiment of the invention, the invention also encompasses other embodiments not inconsistent with the claims.

DESCRIPTION OF A PREFERRED EMBODIMENT

Figure 1:
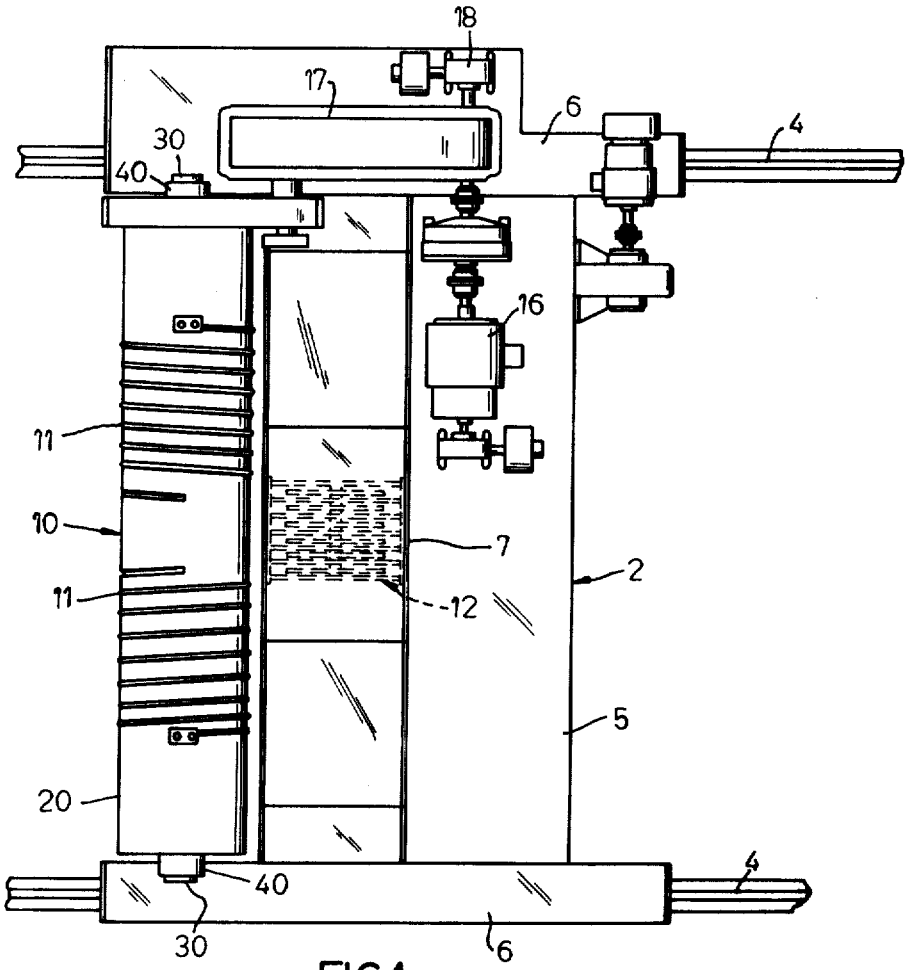
FIG. 1 is a plan view of one embodiment of the overhead crane of the present invention.
Figure 2:
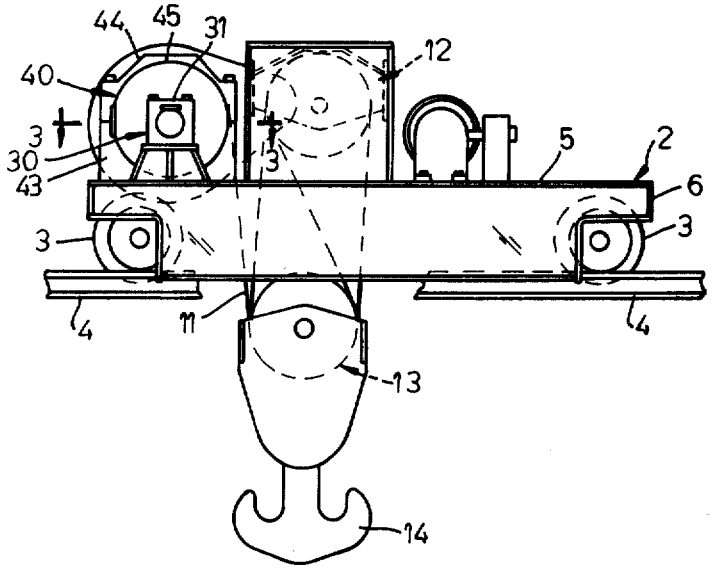
FIG. 2 is a side elevation view of the overhead crane shown in FIG. 1.

The overhead crane of the present invention includes a trolley 2 which comprises the supporting frame structure of the crane and which is supported on wheels 3 for horizontal movement along the rails 4. The trolley 2 is comprised of a rigid frame structure 5 which includes spaced parallel side frame members 6 and a transversely extending frame member 7 joining the side frame members 6.

Figure 3:
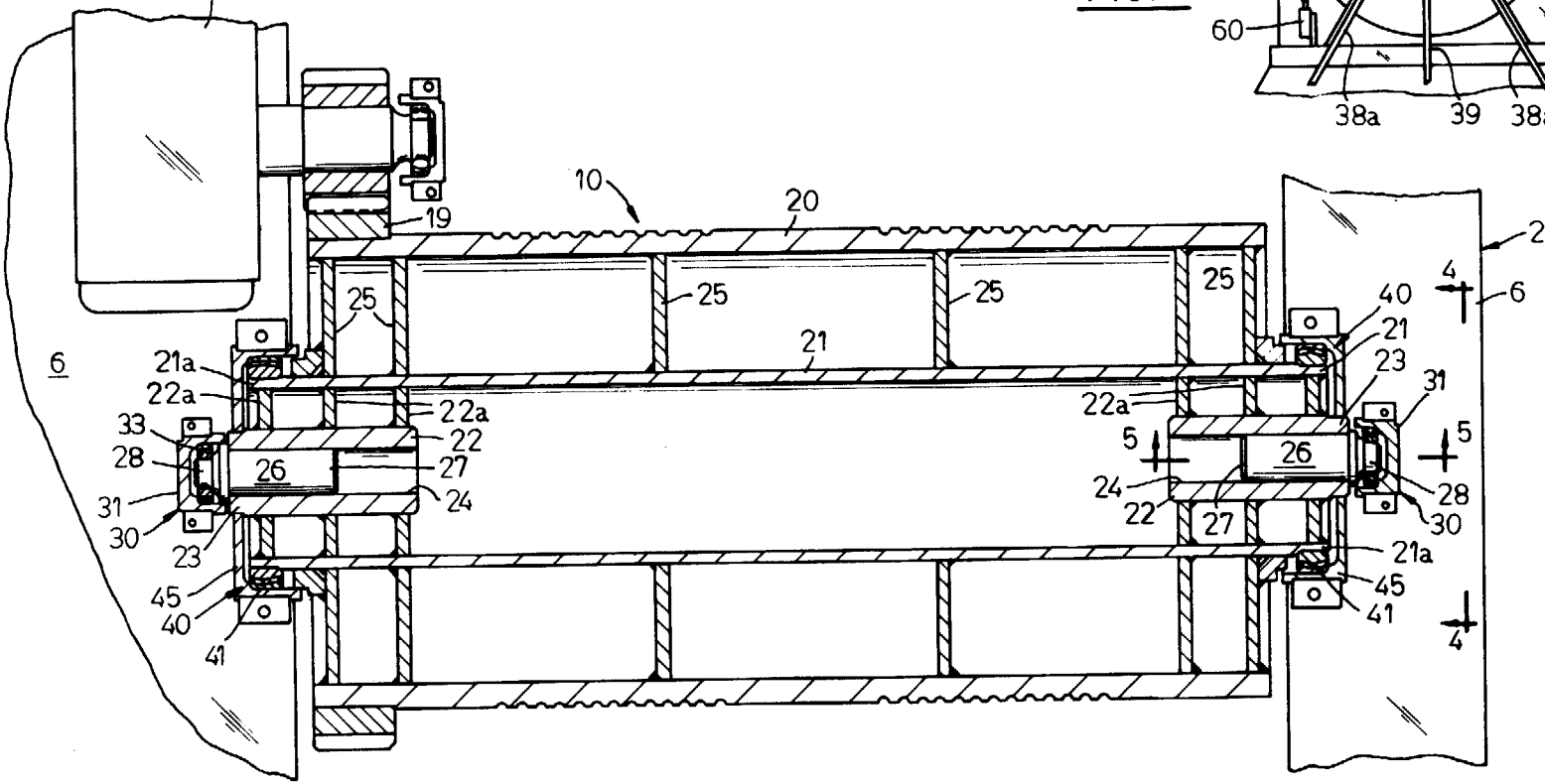
FIG. 3 is an enlarged view taken along line 3—3 of FIG. 2 and showing the hoist drum and hoist drum support means in section.

The trolley 2 is intended to support the hoist assembly of the overhead crane. The hoist assembly is generally comprised of a rotatable hoist drum 10, a pair of wire ropes 11 wound around the hoist drum and reeved through upper and lower sheave block assemblies 12 and 13, respectively, and a hook 14 supported by the lower sheave block. The hoist assembly also includes a drive motor 16 operably connected to one end of the hoist drum 10 through a gear drive assembly 17. A brake assembly 18 is also operably connected to the gear drive assembly 17. As shown in FIG. 3, the hoist drum 10 includes a large gear ring 19 surrounding one of its ends and rigidly secured thereto to provide a driving connection between the gear drive assembly 17 and the hoist drum 10.

The hoist drum 10 is rotatably supported at its opposite ends by the side frame members 6. More specifically, the hoist drum 10 is supported at each of its ends by two bearing assemblies 30 and 40 each fully capable of supporting the weight of the hoist drum such that failure of any single element of a bearing or bearing support structure will not cause disruption of the operation of the hoist drum.

The hoist drum 10 is comprised of a hollow outer drum or cylinder 20 which supports the wire ropes 11. An inner hollow cylinder 21 is received concentrically within the outer drum 20 and is secured therein by a plurality of parallel spaced diaphragms 25 welded to the external surface of the inner hollow cylinder 21 and welded to the inner surface of the outer drum 20. The inner hollow cylinder 21 is longer than the outer drum 20 and includes ends 21*a* which project axially outwardly from each end of the outer drum 20. Each end of the inner hollow cylinder 21 includes a cylindrical drum hub 22 concentrically supported therein by a plurality of spaced, parallel diaphragms 22*a*. The drum hubs 22 each include an end 23 which projects axially beyond the end of inner hollow cylinder 21. Both of the drum hubs 22 include axial cylindrical bores 24 for receiving bearing shafts 26. The bearing shafts 26 each include a cylindrical body portion 27 secured within the cylindrical bores 24 and a projecting end 28 extending axially outwardly and for being received in and supported by the primary bearing assembly 30.

Figure 4:
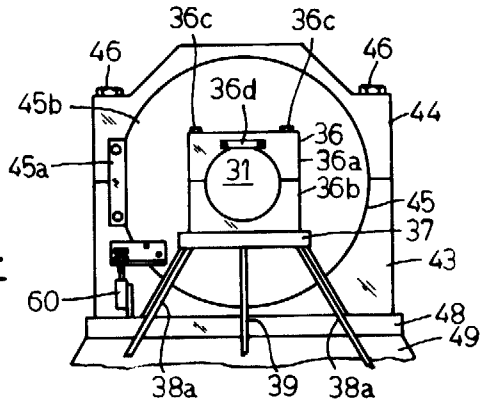
FIG. 4 is a side elevation view taken along line 4—4 of FIG. 3.
Figure 5:
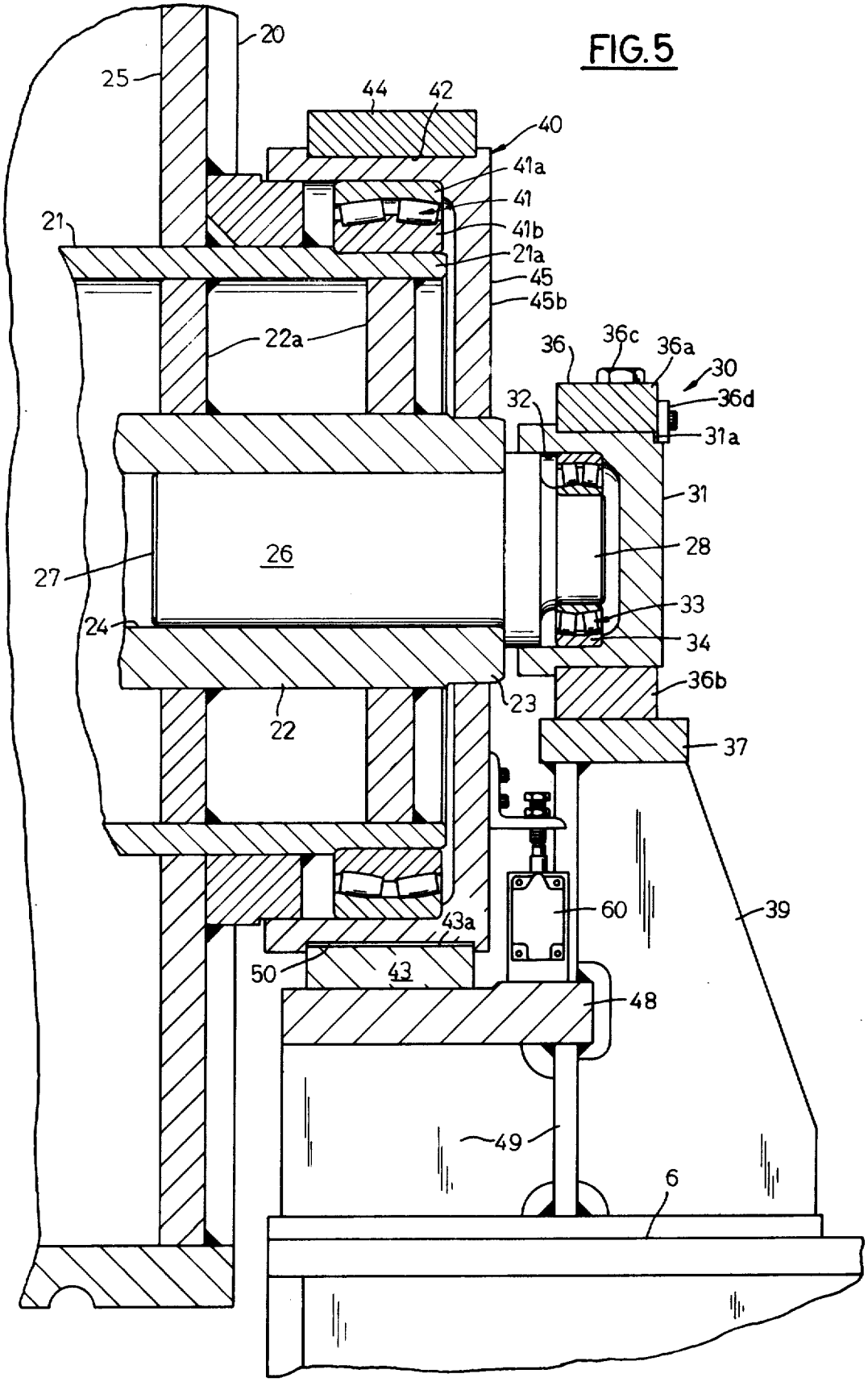
FIG. 5 is an enlarged cross-sectional view taken along the line 5—5 in FIG. 3.

The bearing assemblies 30 are each rigidly supported from the side frame members 6 and function to provide the primary support for the hoist drum 10 during normal operation. As shown in FIGS. 4 and 5, the bearing assemblies 30 each include a generally cylindrical housing or bearing end cap 31 having a cylindrical bore 32 therein for receiving a anti-friction bearing 33. The bearing 33 is intended to rotatably support the end 28 of the bearing shaft 26 and can be comprised of any suitable conventional bearing means, e.g., a roller bearing assembly. The cylindrical bore 32 is intended to rigidly support the outer race 34 of the bearing 33. The housing 31 is rigidly supported within a bearing retainer 36 which is in turn supported by a support structure comprised of a horizontal plate 37 supported from the side frame member 6 by inclined plates 38*a* and by a central vertical plate 39. The bearing retainer 36 is comprised of an upper portion 36*a* and a lower portion 36*b* secured together around the housing 31 by bolts 36*c*. The bearing housing 31 is prevented from rotation within the bearing retainer by plate 36*d* bolted to the bearing retainer and received against a flat surface 31*a* of the housing 31.

As previously stated, it is the function of the bearing assemblies 30 to rotatably support the hoist drum during normal operation. However, an auxiliary or redundant pair of bearing assemblies 40 are provided to function as direct support for the hoist drum in the event there is a failure of any structural component of either of the bearing assemblies 30, their supporting means, the bearing shafts 26 or the drum hubs 22. The bearing assemblies 40 each include roller bearing 41, or the like, which are substantially larger than the bearings 33 and received around the circumference of the projecting ends 21*a* of the inner hollow cylinder 21.

The redundant bearing assemblies 40 each include a lower bearing retainer portion 43 and an upper bearing retainer portion 44 which can be loosely secured together in vertically stacked relation by bolts 46. The bearing retainers 43 and 44 define a cylindrical cavity 42 for loosely receiving a large bearing end cap 45 which in turn securely houses the outer race 41*a* of the large anti-friction roller bearing 41. The bearing end cap 45 is prevented from rotation within the bearing retainer portions 43 and 44 by a plate 45*a* bolted to the bearing retainer portions and received aganst a flat surface 45*b* of the end cap 45. The inner race 41*b* of the bearing 41 is received around the periphery of the end of the inner hollow cylinder 21 in a tightly fitting relationship. When the hoist drum 10 is supported by the bearing assemblies 30, the upper and lower bearing retainers 43 and 44 are not securely clamped together such that there is a clearance 50 between the bottom of the bearing end cap 45 and the supporting surface 43*a* of the lower retainer 43, this clearance being on the order of 1/32 of an inch. Thus, the bearing retainers 43 and 44 do not function to rigidly support the bearing end cap 45 or the bearing 41. The hoist drum is supported by the bearing assemblies 30, and bearing 41 and bearing end cap 45 are allowed to float, being supported by the ends 21*a* of the inner hollow cylinder 21.

The lower bearing retainer 43 are each supported upon horizontal support plates 48 which extend transversely with respect to the axis of the hoist drum 10 and which are supported from the frame members 6 of the trolley 2 by rigid brace members 49. The brace members 49 and the supporting plates 48 are intended to support the bearing assemblies 40 should there be any failure of the bearing assemblies 30 which should cause the end of the hoist drum to drop.

By providing the hoist drum of the present invention with two concentric support shafts, i.e., the inner hollow cylinder 21 and the bearing shaft 26, each being independently supported by a bearing assembly, the hoist drum is rotatably supported despite a failure of any single component of these supporting means. Merely providing a single support shaft supported at each end by a pair of bearings would be less effective because, though there would be redundant support in the event there was a failure of one of the bearing assemblies, failure of the single support shaft could cause complete failure of the hoist drum. In the present invention, on the other hand, despite a failure of one of the bearing shafts 26 or of one of the drum hubs 22, the inner hollow cylinder 21, supported by the bearing assembly 40, will assume support for the hoist drum 10.

It should be noted that the clearance 50 between the bottom of bearing ends caps 45 and the lower bearing retainers 43 is very narrow such that the hoist drum 10 is not allowed a substantial drop in the event of a failure of the primary support means. Thus there will be little impact loading. To further reduce any impact, a resilient pad or high viscosity liquid may be placed between the bottom of the bearing end caps 45 and the upper surfaces 43*a* of the lower bearing retainers 43.

A switch 60 is disposed between the frame member 6 and the bearing end cap 45. The switch is provided to sense downward movement of the bearing end cap 45 as it rests against the lower bearing retainer 43 and thus signal the crane operator that a failure has occurred. Suitable switches 60 can be comprised of load cells or micro switches.

In the event that the operator receives a signal that a failure has occurred, the bolts 46 can then be tightened such that the upper and lower bearing retainers 43 and 44 will be securely received around the bearing end caps 45 to properly support the bearing end caps and then operation of the crane can be continued to properly dispose of the load upon the crane at the time of failure.

RESUME

By providing two independently supported pairs of bearing assemblies for supporting the ends of the hoist drum, and by providing the inner hollow cylinder and the concentrically supported bearing shafts, each independently supporting the hoist drum, the overhead crane of the invention provides a means for rotatably supporting the hoist drum despite failure of any single component of the means supporting the hoist drum and including failure of one of the bearing shafts. A further advantage of the hoist drum of the invention is that it provides a substantially less complicated means for ensuring support for a critical load than have been previously provided by the prior art use of plural hoist drums and their requisite plural drive systems. An additional advantage of the invention is that the hoist drum is rotatably supported even after failure of one of the supporting elements. As a result, it is not necessary to suspend operation of the hoist drum after such a failure and the load on the crane can be properly disposed of.

I claim:

1. In an overhead crane:

a frame;

a hoist drum having opposite ends;

first anti-friction bearing means supported by said frame and rotatably supporting each of said opposite ends of said hoist drum;

second anti-friction bearing means rotatably supported on said hoist drum and axially spaced from said anti-friction bearing means in which said opposite ends of said hoist drum are journalled, said first anti-friction bearing means supporting said second anti-friction bearing means out of supporting engagement with said frame, and means supported by said frame for supporting said second anti-friction bearing means upon failure of said first anti-friction bearing means, said means for supporting said second anti-friction bearing means including a supporting surface spaced below said second anti-friction bearing means when said hoist drum is supported by said first anti-friction bearing means and for receiving said second anti-friction bearing means in supporting engagement upon downward movement of said hoist drum upon failure of said first anti-friction bearing means.

2. The overhead crane set forth in claim 1 further including a support cylinder having opposite ends and positioned concentrically within and rigidly secured to said hoist drum for supporting said hoist drum, said support cylinder having its opposite ends rotatably journalled within said second anti-friction bearing means, and support shafts supported concentrically within said opposite ends of said support cylinder and journalled within said first anti-friction bearing means.

3. The overhead crane set forth in claim 1 further including sensing means between said hoist drum and said frame for sensing relative vertical movement of said hoist drum and said frame and for providing a signal indicative of failure of said first anti-friction bearing means to support said hoist drum.

4. In an overhead crane:

a frame;

a hoist drum having opposite ends;

first support means for rotatably supporting said opposite ends of said hoist drum, said first support means including support members secured to said frame and first anti-friction bearing means operably connected to said opposite ends for rotatably supporting said opposite ends, said first anti-friction bearing means being supported by said support members; and redundant support means for rotatably supporting said opposite ends of said hoist drum upon failure of said first support means, and including second anti-friction bearing means operably connected to said opposite ends of said hoist drum and supported by said hoist drum when said hoist drum is rotatably supported by said first anti-friction bearing means, and including second support means supported by said frame and for supporting said second anti-friction bearing means upon downward movement of said hoist drum upon failure of said first support means, said second support means including a supporting surface spaced below said second anti-friction bearing means when said second anti-friction bearing means is supported by said first support means and for receiving said second anti-friction bearing means in supporting engagement thereagainst upon downward movement of said hoist drum.

5. The overhead crane set forth in claim 4 wherein said first anti-friction bearing means includes a pair of axially spaced apart first bearings, one of said pair of first bearings rotatably connected to one of said opposite ends of said hoist drum and the other of said pair of first bearings rotatably connected to the other of said opposite ends of said hoist drum, and said second anti-friction bearing means including a second pair of axially spaced apart second bearings, one of said second pair of second bearings being rotatably connected to one of said opposite ends of said hoist drum and the other of said second pair of second bearings being retatably connected to the other of said opposite ends of said hoist drum.

6. The overhead crane set forth in claim 4 further including sensing means between said hoist drum and said frame for sensing relative vertical movement of said hoist drum and said frame and for providing a signal indicative of failure of said first support means to support said hoist drum.

7. The overhead crane set forth in claim 4 further including a support cylinder positioned concentrically within and secured to said hoist drum and for supporting said hoist drum, said support cylinder having its ends rotatably journalled within said second anti-friction bearing means, and a support shaft supported concentrically within the ends of said support cylinder and for supporting said support cylinder and said hoist drum, said support shaft including projecting ends journalled within said first anti-friction bearing means whereby said support shaft is rotatably supported by said first anti-friction bearing means.

8. In an overhead crane:

a frame;

a hoist drum having opposite ends and including a support cylinder rigidly support concentrically therein and for supporting said hoist drum, said support cylinder having an end projecting axially out of one of said opposite ends of said hoist drum, and further including a support shaft supported concentrically within said support cylinder for supporting said support cylinder and said hoist drum, said support shaft including an end projecting axially out of said end of said support cylinder;

a first anti-friction bearing means supported by said frame and rotatably supporting said opposite ends of said hoist drum; and a second anti-friction bearing means including anti-friction bearings for rotatably supporting said opposite ends of said hoist drum upon failure of said first anti-friction bearing means, said second anti-friction bearing means further including a support surface spaced from said anti-friction bearings;

said end of said support cylinder being journalled within said anti-friction bearings and said end of said support shaft being journalled within said first anti-friction bearing means.

* * * * *